US012214294B2

(12) United States Patent
Fargher et al.

(10) Patent No.: US 12,214,294 B2
(45) Date of Patent: Feb. 4, 2025

(54) GREYHOUND RACING LURE ARRANGEMENT

(71) Applicants: Steriline Racing Pty Ltd, Mount Barker (AU); Covey Associates Pty. Ltd., Maroochydore (AU)

(72) Inventors: John Fargher, Mount Barker (AU); Kevin Covey, Maroochydore (AU)

(73) Assignees: Steriline Racing Pty Ltd, Mount Barker (AU); Covey Associates Pty. Ltd., Maroochydore (AU)

( * ) Notice: Subject to any disclaimer, the term of this patent is extended or adjusted under 35 U.S.C. 154(b) by 928 days.

(21) Appl. No.: 17/288,199

(22) PCT Filed: Oct. 25, 2019

(86) PCT No.: PCT/AU2019/000136

§ 371 (c)(1),
(2) Date: Apr. 23, 2021

(87) PCT Pub. No.: WO2020/082107

PCT Pub. Date: Apr. 30, 2020

(65) Prior Publication Data

US 2021/0402315 A1 Dec. 30, 2021

(30) Foreign Application Priority Data

Oct. 26, 2018 (AU) ..... 2018904065

(51) Int. Cl.
*A63K 1/02* (2006.01)
*A63K 3/00* (2006.01)

(52) U.S. Cl.
CPC . *A63K 1/02* (2013.01); *A63K 3/00* (2013.01)

(58) Field of Classification Search
CPC ..... A63K 3/00; A63K 1/02
See application file for complete search history.

(56) References Cited

U.S. PATENT DOCUMENTS 1,728,576 A * 9/1929 Schem ..... A63K 1/02 472/87
1,756,044 A * 4/1930 White ..... A63K 1/02 472/87

(Continued)

FOREIGN PATENT DOCUMENTS

DE 10 2015 102 295 A1 8/2016
GB 1 510 335 A 5/1978

OTHER PUBLICATIONS

International Search Report and Written Opinion for International Application No. PCT/AU2019/000136, dated Nov. 25, 2019, 10 pages.

*Primary Examiner* — Scott A Browne
(74) *Attorney, Agent, or Firm* — Westman, Champlin & Koehler, P.A.

(57) ABSTRACT

Disclosure in this specification is of a greyhound lure support carrier engageable with a support track is located about a greyhound racing track. The support carrier is engageable and disengageable from the track in one example, the carrier housing supports multiple wheels some of which are in constant contact with the track to drive the carrier housing along the track and other wheels are free-wheeling guides along the track and to ensure the carrier housing stays on the track. The support carrier comprises a chassis accommodating, a battery to supply electric power; an electric motor having an axle, the electric motor operatively connected to the battery, and to drive the rotation of an axle; a rotatable friction arrangement connected to a driven axle and located so as to frictionally engage with the support track. There is a suspension arrangement moveable against a portion of the support track to permit suspension of the chassis from the support track. There is also a wireless communication receiver for receiving a signal for operating application of electric power to the electric motor. An (Continued)

electric motor control module is in operative connection to the wireless communication receiver and operable to the electric motor. A lure arrangement is attachable to the carrier for attracting greyhounds as the carrier is controlled in its travel about the track.

20 Claims, 9 Drawing Sheets

(56) References Cited

U.S. PATENT DOCUMENTS

| | | | | | |
|---|---|---|---|---|---|
| 1,784,837 | A * | 12/1930 | Hiatt | F16C 5/00 | 74/579 E |
| 1,787,604 | A * | 1/1931 | Throckmorton | A63K 1/02 | 104/243 |
| 1,847,976 | A * | 3/1932 | Oldham | A63K 1/02 | 104/140 |
| 2,869,478 | A | 1/1959 | White | | |
| 4,280,694 | A | 7/1981 | Trickel | | |
| 2016/0114238 | A1* | 4/2016 | Santino, Jr. | A63K 3/023 | 340/4.13 |

* cited by examiner

GREYHOUND RACING LURE ARRANGEMENT

CROSS-REFERENCE TO RELATED APPLICATION

This Application is a Section 371 National Stage Application of International Application No. PCT/AU2019/000136, filed 25 Oct. 2019, and published as WO 2020/082107 A1 on 30 Apr. 2020, in English, the contents of which are hereby incorporated by reference in their entirety.

FIELD

The field of the disclosure is motorised greyhound racing track lures.

BACKGROUND

The greyhound racing industry has for a very long period used an artificial lure to lead the racing greyhounds about the racing track. There have been many versions of such lure arrangements.

The requirement of any lure includes the need for the lure to move around the racing track just in front of the greyhounds and this requires that the lure has a controllable velocity so that the differing pace of the greyhounds during a race can be accommodated as well as the overall different pace of different quality greyhounds, race to race.

One example of such an arrangement is a motorised support carriage (wheeled support carrier) running along an alternating current electrified track located near the top rail of the greyhound racing track barrier being one location of the electrified track about the greyhound racing track. The electrified track supports a carriage in or on which is mounted an Alternating Current (AC) motor. The carriage is driven along the support track by the traction of a rubberized wheel attached to the driven axle of the AC motor, and brushes or similar electrical connections, close the circuit of the AC motor to the electrified support track. The electrical current entering the support track is controlled by an operator, which results in an increase or decrease of the speed of the rotation of the spindle of the electric motor and hence the velocity of the lure attached to the carriage.

In another example, a cable is supported at intervals along a greyhound racing track barrier and attached to a carriage which is drawn along a support track; the support track is mounted on or suspended from the greyhound racing track barrier, in one location of the electrified track about the greyhound racing track. The carriage supports a lure and is also connected to the cable. As the cable is drawn about the racing track, the lure is also moved about the racing track. The cable is drawn by a friction coupling driven by an AC electric motor that is controlled by an operator at velocity controllable by the operator supplying variable current or frequency.

Each of the above-described systems and others in use in the greyhound racing industry is expensive to run and require high levels of maintenance to ensure reliability.

BRIEF DESCRIPTION OF ASPECTS OF THE DISCLOSURE

This Summary is provided to introduce a selection of concepts in a simplified form that is further described below in the Detailed Description. This Summary is not intended to identify key or essential features of the claimed subject matter, nor is it intended to be used to limit the scope of the claimed subject matter. Other features, details, utilities, and advantages of the claimed subject matter will be apparent from the following written Detailed Description, including those aspects illustrated in the accompanying drawings and defined in the appended claims.

In an aspect of the disclosure a greyhound lure support carrier engageable with a support track is located about a greyhound racing track. The support carrier is engageable and disengageable from the track in one example, the carrier housing supports multiple wheels some of which are in constant contact with the track to drive the carrier housing along the track and other wheels are free-wheeling guides along the track and to ensure the carrier housing stays on the track one or more wheels can be moveable or removable to allow the wheels to be placed onto or near the track. In another arrangement, the carrier housing is adapted to slide onto an open end of the track, say at either end or at selected locations along the track when a piece of the track can be removed to permit the carrier housing to be slid off the track at that selected location. The support carrier also comprises a chassis accommodating, a battery to supply electric power; an electric motor having an axle, the electric motor operatively connected to the battery, and to drive the rotation of an axle; a rotatable friction arrangement connected to a driven axle and located so as to frictionally engage with the support track; a suspension arrangement moveable against a portion of the support track to permit suspension of the chassis from the support track; a wireless communication receiver for receiving a signal for operating application of electric power to the electric motor; an electric motor control module in operative connection to the wireless communication receiver and operable to the electric motor; and a lure arrangement to attract greyhounds.

In a further aspect, the greyhound lure support carrier further comprises at least one guide element to maintain a distance separation of the support carrier from the support track when the support carrier is moving along the support track.

In another aspect, the support track has a vertical surface, and wherein the at least one guide element further comprises, a free-wheeling wheel in a wheel support assembly, the assembly attached to the chassis and located such that the free-wheeling wheel moves along the vertical surface of the support track.

In an aspect, the at least one guide element further comprises, an elastomeric element located between the chassis and the wheel support assembly arranged to dampen the motion, in use, of the wheel support assembly and bias the free-wheeling wheel against the vertical surface of the support track.

In an aspect, the greyhound lure support carrier wherein the support track has a horizontal surface, and wherein the at least one suspension arrangement comprising a free-wheeling wheel in a wheel support assembly attached to the chassis and located so as to free-wheel on a horizontal surface of the support track.

In an aspect, the greyhound lure support carrier wherein the support track has a horizontal surface, and wherein the suspension arrangement is a surface element attached to the chassis that slides against a horizontal surface of the support track.

In an aspect of the greyhound lure support carrier, the battery is removable and replaceable with another battery.

In an aspect, the battery is rechargeable while located within the carrier housing.

In an aspect of the greyhound lure support carrier, the lure further includes a displacement and suspension arm which positions the lure of the lure arrangement over and above the greyhound racing track surface.

In an aspect, there is a greyhound racing system comprising at least a support track positioned about a greyhound racing track for supporting a greyhound lure support carrier engageable with the support track. The lure support carrier comprising: a chassis accommodating the following elements: a battery to supply electric power; an electric motor having a driven axle and the electric motor operatively connected to the battery to drive the rotation of the driven axle; a rotatable friction arrangement connected to the driven axle and located so as to frictionally engage with the support track; a suspension arrangement moveable against a portion of the support track to permit suspension of the chassis from the support track; a wireless communication receiver for receiving a signal for operating application of electric power to the electric motor; and an electric motor control module in operative connection to the wireless communication receiver and the electric motor. There is also a lure attachment arrangement and a wireless communication transmitter for transmitting a signal to the wireless communication receiver for controlling the operating application of electric power to the electric motor and a user control to control the signal, wherein a lure is attachable to the chassis, the lure adapted to attract greyhounds as the support carrier moves along the support track.

In an aspect, there is a greyhound racing system wherein the support track comprises multiple elongate support track portions, and a part of each track portion has a rectangular cross-section and orientated with the longest sides of the rectangular cross-section of the track portion vertical and the narrowest sides of the rectangular cross-section of the track portion horizontal.

In an aspect, wherein each end of the elongate support track portion is scarfed such that when elongate support track portions are abutted such that the scarfed end of another support track portion abuts the scarfed end of an adjacent support track portion there is an overlap of the horizontal upper surfaces of the elongate support track portions.

In an aspect the greyhound racing system further comprises an end-of-line support track portion located at an end of the support track, the end-of-line support track portion having a centrally located opening such that the rotatable friction arrangement no longer engages with the support rack when the rotatable friction arrangement enters the opening in the end-of-line support track and wherein there is an energy-absorbing element located adjacent the end-of-line support track portion arranged to mechanically or hydraulically dissipate the energy of a greyhound lure support carrier impacting on the energy-absorbing element.

"Software", as used herein, includes but is not limited to one or more computer-readable and executable instructions that cause a computer or other electronic device to perform functions, actions, and initiation of actions and behave in a desired manner. The instructions may be embodied in various forms such as routines, algorithms, software modules, or programs including separate applications or code from dynamically linked libraries. The software may also be implemented in various forms such as a stand-alone program, a function call, a servlet, an applet, instructions stored in a memory, part of an operating system or another type of executable instruction. It will be appreciated by one of ordinary skill in the art that the form of software is dependent on, for example, requirements of a particular application, the environment it runs on, and the desires of a designer/programmer or the like.

Those of skill in the art would further appreciate that the various illustrative logical blocks, modules, circuits, and algorithm steps described in connection with the embodiments disclosed herein may be implemented as electronic hardware, computer software, or combinations of both. To illustrate this interchangeability of hardware and software, various illustrative components, blocks, modules, circuits, and steps have been described above, generally regarding their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the embodiments disclosed herein may be embodied directly in hardware, in a software module executed by a processor (or microprocessor or microcontroller), or in a combination of the two. A computer server is a collection of hardware and software which provides functionality for other programs or devices, local and remote of the physical hardware and on which one or more virtual servers may reside and operate. A computer server may work in the client-server mode wherein a client sends a request or data to the server, and the server responds by processing the request or data and returning data and instructions. For a hardware implementation, processing may be implemented within one or more application-specific integrated circuits (ASICs), digital signal processors (DSPs), digital signal processing devices (DSPDs), programmable logic devices (PLDs), field-programmable gate arrays (FPGAs), processors, controllers, micro-controllers, microprocessors, other electronic units designed to perform the functions described herein, or a combination thereof. Software modules, also known as computer programs, computer codes, or instructions, may contain several source code or object code segments or instructions and may reside in any computer-readable medium. Examples of such mediums include RAM, flash memory, ROM, EPROM, registers, hard disk, a removable disk, a CD-ROM, a DVD-ROM or any other form of transitory and non-transitory computer-readable storage medium. In the alternative, the computer-readable medium may be integral to the processor. The processor and the computer-readable medium may reside in an ASIC or related device. The software codes may be stored in a memory unit and executed by a processor. The memory unit may be implemented within the processor or external to the processor, in which case it can be communicatively coupled to the processor via various means as is known in the art.

It will be appreciated by those skilled in the art that the embodiments are not restricted in their use to the particular application described. Neither are the presented embodiments restricted in their embodiments with regard to the particular elements and features described or depicted herein. It will be appreciated that various modifications can be made without departing from the principles disclosed. Therefore, the embodiments should be understood to include all such modifications within their scope.

DETAILED DESCRIPTION OF EMBODIMENTS

The weight and reliability considerations identified as problems have required a new approach to the provision of a greyhound racing lure arrangement. The use of a cable and large-scale electrification is to be avoided as they are major contributors to the cost of operation and maintenance of existing systems. The alternative however is not necessarily in the provision of better cables (newer, stronger, lighter and more durable material) or in an alternative to using AC (high current at low voltage) by using Direct Current, or in using lighter and more resilient lures, or in the use of lighter and more efficient electric motors.

In an embodiment there is a greyhound lure support carrier accommodating a power controlled electric motor, support track traction engagement arrangement, a carrier suspension arrangement (the carrier needs to be moveably susspended from the track), a wireless communication receiver, along with a rechargeable battery of sufficient capacity to provide multiple race condition operations of the electric motor to provide a platform from which a lure to attract greyhounds can be suspended, for example in an embodiment a 21 Ah capacity. The battery can, in an embodiment be recharged at a station located on or beside the rail after each race. Such a recharging arrangement would potentially last significantly longer than the use of single-use lithium battery and decrease the total weight of the system. The motorised platform is suspended from a support track, one location of the support track about the greyhound racing track being defined by an existing barrier or which forms the barrier, typically the inside barrier of the greyhound racing track, and the support carrier can be remotely controlled by an operator.

In an embodiment, the electric motor is mounted within a single carrier housing having a chassis 1 and arranged such that the rotation of the driven axle of the electric motor actuates the rotation of the rim of a wheel having a tyre. It would also be possible to use a tank track (e.g. an elongate loop of rubber with at least two spaced rotating axles, with at least one of them being driven, also sometimes referred to as continuous track or caterpillar track) instead of a wheel. The circumferentially mounted tyre portion of the driven wheel can be of an elastomeric material, suitable in form and function, for creating traction against a suspended support track or guide extending about the greyhound racing track. The form of the support track of the embodiment disclosed in FIGS. 2 and 6 is that of an elongate rectangular cross-section strip of metal forming a suspended support track from which the carrier housing is suspended.

Figure 6:
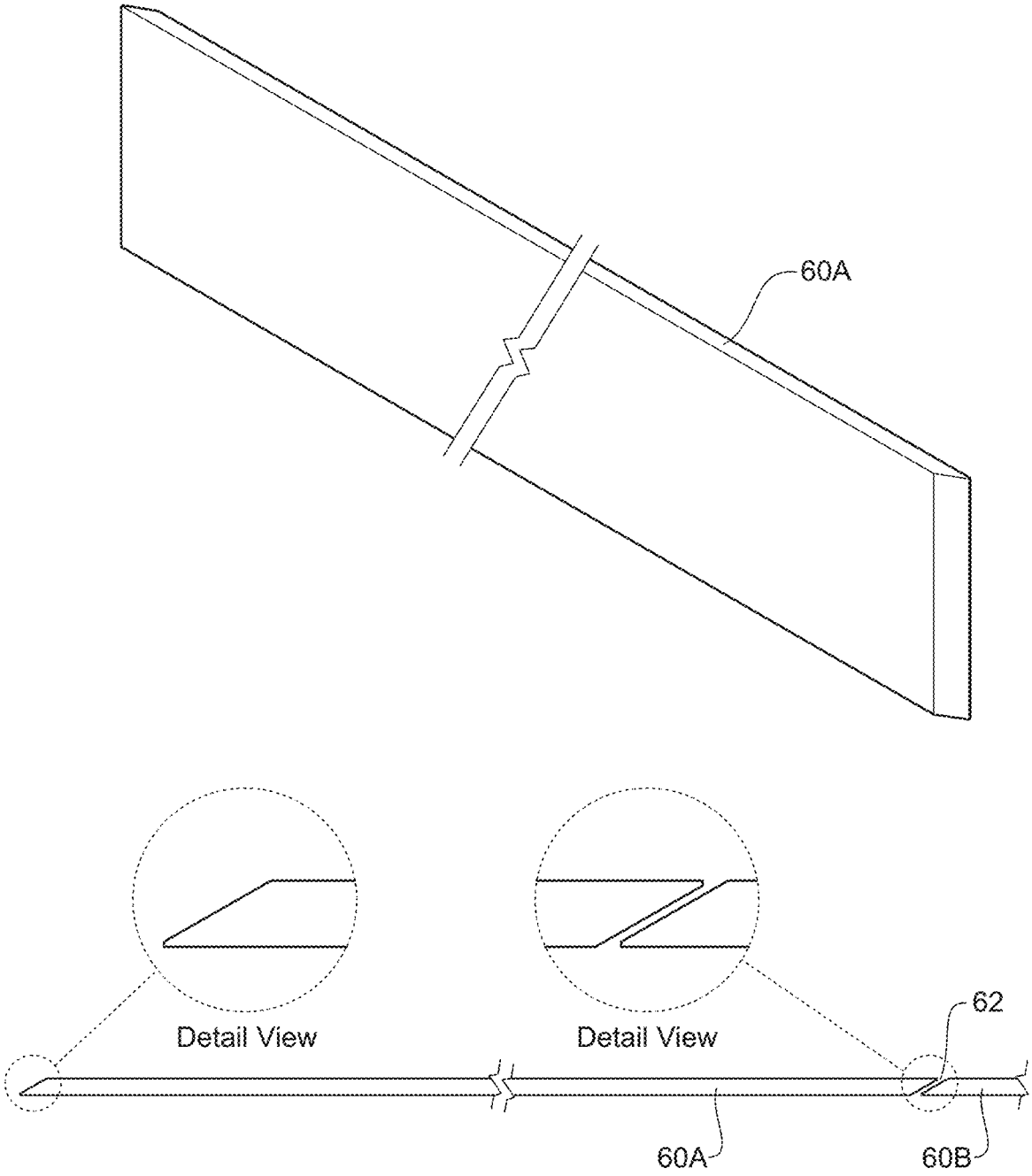
FIG. 6 depicts a perspective view and a top view of one embodiment of a support track portion.

FIG. 6 depicts a perspective view and a top view of one embodiment of the support track. The perspective view is of a support track section of indefinite length, and in an embodiment, the sections are 6 metres long, and in another embodiment, they are 5 metres long. The top view of the same section of the support track depicts a bevel at each end of the section, and when mated to another bevelled end, a plain scarf joint is created between the sections. When the sections are installed as also depicted at 60*a* and 60*b*, a predetermined spacing is provided between the flat surfaces of the scarf jointed support track sections to account for expansion and contraction. In an example, the spacing is 5 mm to account for a temperature variation of 0° C. to 80° C. using mild steel of 5 metres length. The scarf joint 62 (FIG. 6) creates an overlap of the horizontal upper surfaces of the support track portions 60A and 60B when those ends are abutted, thus in the embodiment of the support carrier that uses wheels, each wheel is always rolling over an upper surface of the support track. The use of a scarf joint promotes a smooth transition of movement by the support carrier to the benefit of the long-term reliability of the chassis 1 of the support carrier and the various elements therein, including the circuit board mounted components and the mechanical fixings, etc. Reliability is improved over the use of some other joint types since there is likely to be less vibration at each transition between support track sections when the suspension arrangement is movable on a horizontal surface (a top portion) of the support track. It is possible for there to be different track shapes and different suspension arrangements, in particular, it is not necessary for the carrier suspension arrangement to move over a horizontal surface of the track, it may fall within a channel in the track or on a sloped surface provided along the track. The guide elements (typically in a support assembly having free-wheeling wheel) can be arranged to apply the wheel or other low friction element onto any surface of the track.

However, the suspended support track may in one embodiment comprise a stationary cable (as opposed to a moving cable), and the support carrier is formed and arranged to follow the path formed by the cable. In this latter described embodiment (not depicted) the support carrier will configure the same stated elements in a manner that is suitable to accommodate the cable, such as, for example, the electric motor provides rotational energy to a rotatable friction arrangement such as a track, or a series of rotating friction applying arms operable much like a dreadnaught wheel while the support carrier is suspended and moveable along the support cable. There are many possible rotatable friction arrangements.

Figure 1:
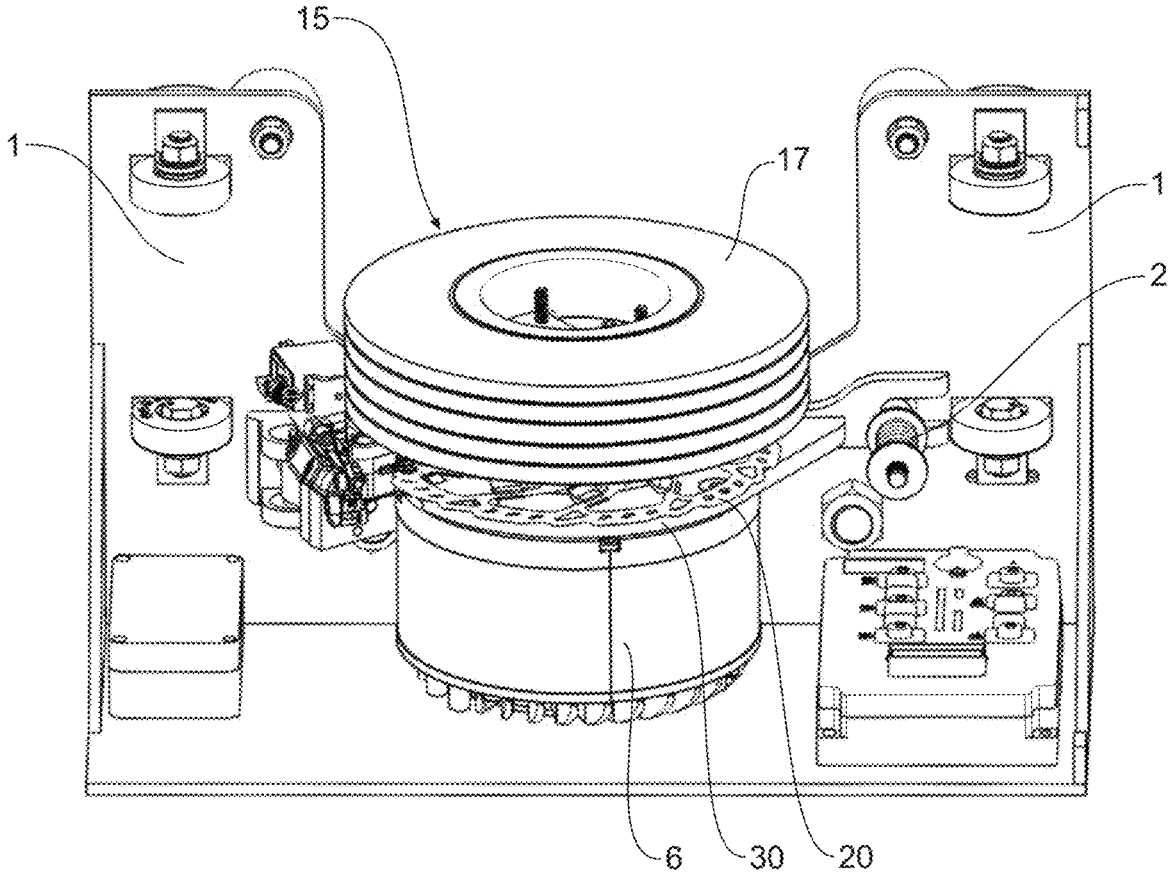
FIG. 1 depicts a perspective view of the inside of the carrier housing according to an embodiment.
Figure 2:
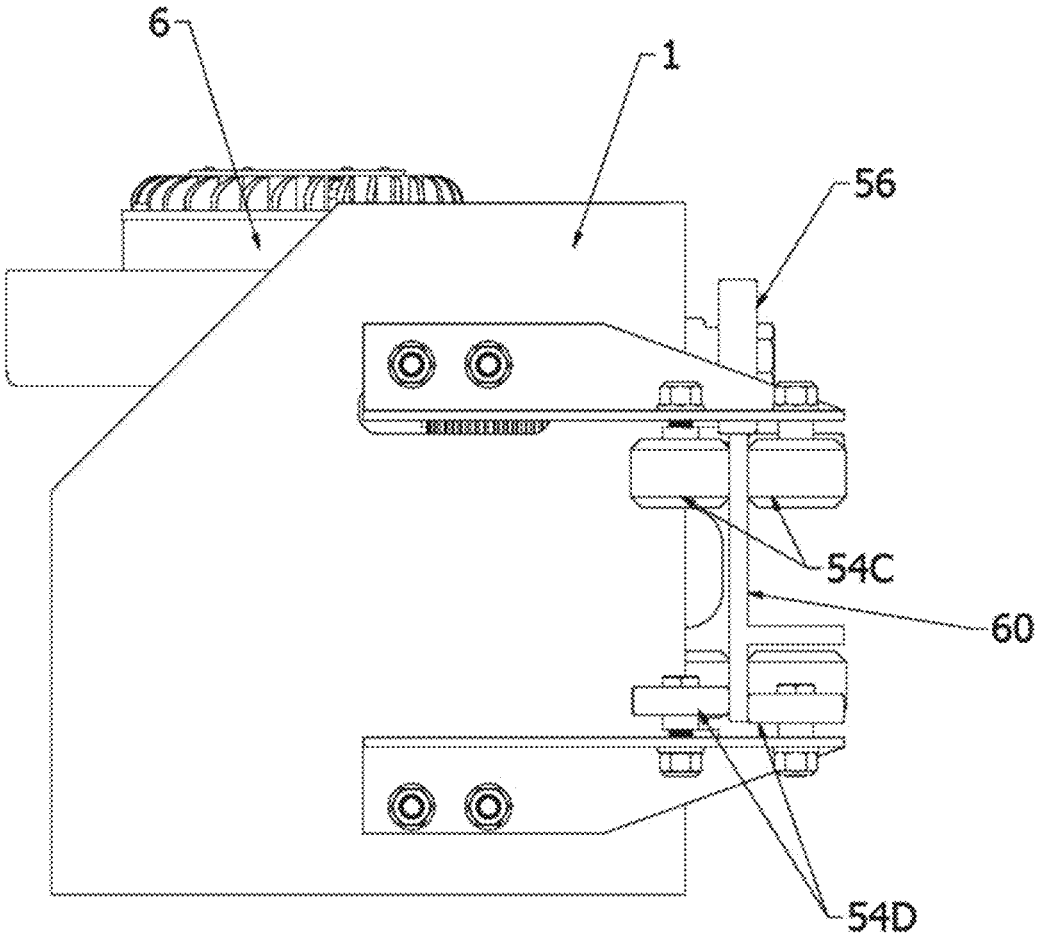
FIG. 2 depicts a side view of the outside of a carrier housing mounted to a support track.

In the embodiment depicted in FIGS. 1 and 2 at least one guide element is formed by two pairs of guide wheel pairs each pair located near the front and rear of the assembly (both directions defined with respect to the direction of travel). The guide wheels engage both the top and bottom regions of the vertically orientated support track 60 (the longest sides of the rectangular cross-section of the support track) and space the chassis of the support carrier from at least one of the vertical surfaces of the support track in FIG. 2, which depicts the mounting of the pair of guide wheels 54C and 54D on brackets fixed to the exterior of the chassis. In the embodiment of FIG. 1, one of the pairs of wheels is fixed to the interior wall of the chassis while the other of the pair is fixed to the exterior of the chassis.

In a further embodiment (not depicted) there is a suspension arrangement formed as at least one surface element attached to the chassis that slides against a horizontal surface of the support track. The material of the surface element can be high wear-resistant plastic with a low coefficient of friction or hardened metal of suitable composite compounds or elements.

In an embodiment, the guide wheels or surface elements are mounted separately to the chassis and have a dampening system between them and the chassis to lessen vibrational impacts on the lure housing and the components therein.

Figure 9A:
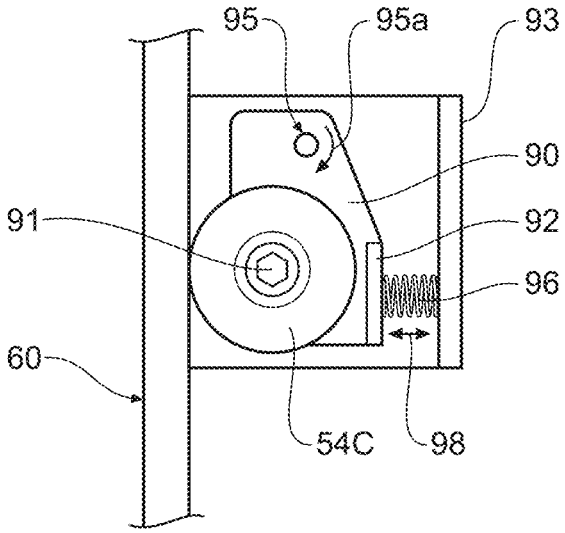
FIG. 9A is an under-side view of a wheel and a top view of the support track depicting one embodiment of a suspension interacting with the chassis and the side of the support track.
Figure 9B:
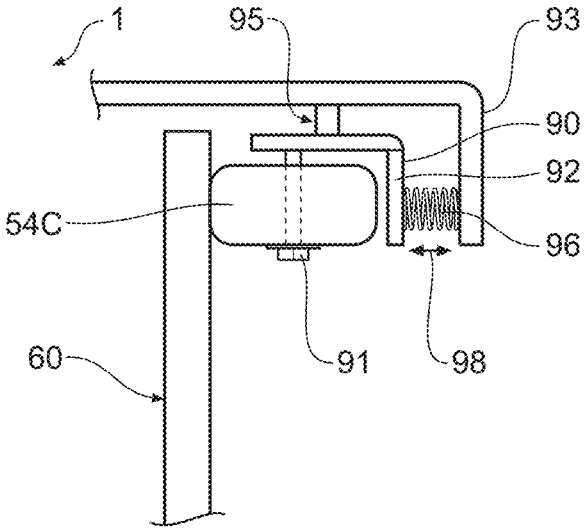
FIG. 9B is a side view of a wheel and a side view of the support track depicting the embodiment the suspension of FIG. 9A interacting with the chassis and the side of the support track.

FIG. 9A is an under-side view of guide wheel 54C and a top view of the elongate support track 60 (FIGS. 5 and 6) depicting an embodiment of a suspension arrangement interacting with the chassis and the side of the support track. In this embodiment the suspension arrangement comprises a guide wheel 54C mounted so that it can rotate about an axle 91 with one end of the axle fixed to a suspension arm 90. The suspension arm is rotatably connected 95 to the wheel mounting bracket 93. See the arrow 95*a* which indicates the rotational movement of the suspension arm (and thus the guide wheel) relative to the wheel mounting bracket. The wheel mounting bracket is fixed to the chassis 1 (see FIG. 9B). An elastomeric element 96 (in this particular embodiment a coil spring) is fixed on one surface (in this embodiment one end of the spring) to the wheel bracket and on another surface (in this embodiment at the other end of the spring) to the suspension arm. Thus, the guide wheel is biased towards the side of the vertically orientated support rail 60 but capable of moving (see the arrow 98 of FIGS. 9A and 9B) towards the wheel bracket as it meets non-flat regions or uneven regions along the surface of side wall of the support rail/s. FIG. 9B is a side view of a wheel and a side view of the support track 60 depicting the embodiment of the suspension arrangement depicted in FIG. 9A interacting with the wheel bracket and the side, and near the top of the vertically mounted support track. The embodiment depicted is but one way of providing suspension of the guide wheels and one or more of the suspension arrangement is useable with the other guide wheels.

There is in another embodiment an additional pair of freely rotating wheels 56 (free-wheeling) which comprise a suspension arrangement (not depicted) positioned so as to allow the free-wheeling wheels to roll along the upper horizontal surface of the vertically orientated support track used in this embodiment. The support track comprises multiple elongate support track portions a portion thereof having a rectangular cross-section and orientated with the longest sides of the rectangular cross-section of the track portion vertical and the narrowest sides of the rectangular cross-section of the track portion horizontal. The freely rotating wheels 56 in this embodiment assist the suspension of the carrier housing from the particular support track 60 depicted in FIGS. 2, 5 and 6.

An aperture through the carrier housing and chassis of the carrier housing enables the portion of the tyre of the driven wheel to frictionally engage with a vertical side wall of a vertically orientated support track in either dry or wet conditions. However, if the support carrier is of the type that allows for the support track to enter and exit the support carrier, then the location of the area of frictional engagement between the rotatable friction arrangement and the support track would be internal of the support carrier.

Wireless remote operation of the electric motor is achieved by using a remote control operable by an operator situated such that they can observe the relative position of the support carrier and attached lure with respect to the pursuing greyhounds over the full circuit of the support track which lies adjacent to the existing barrier rails of a greyhound racing track.

Figure 3A:
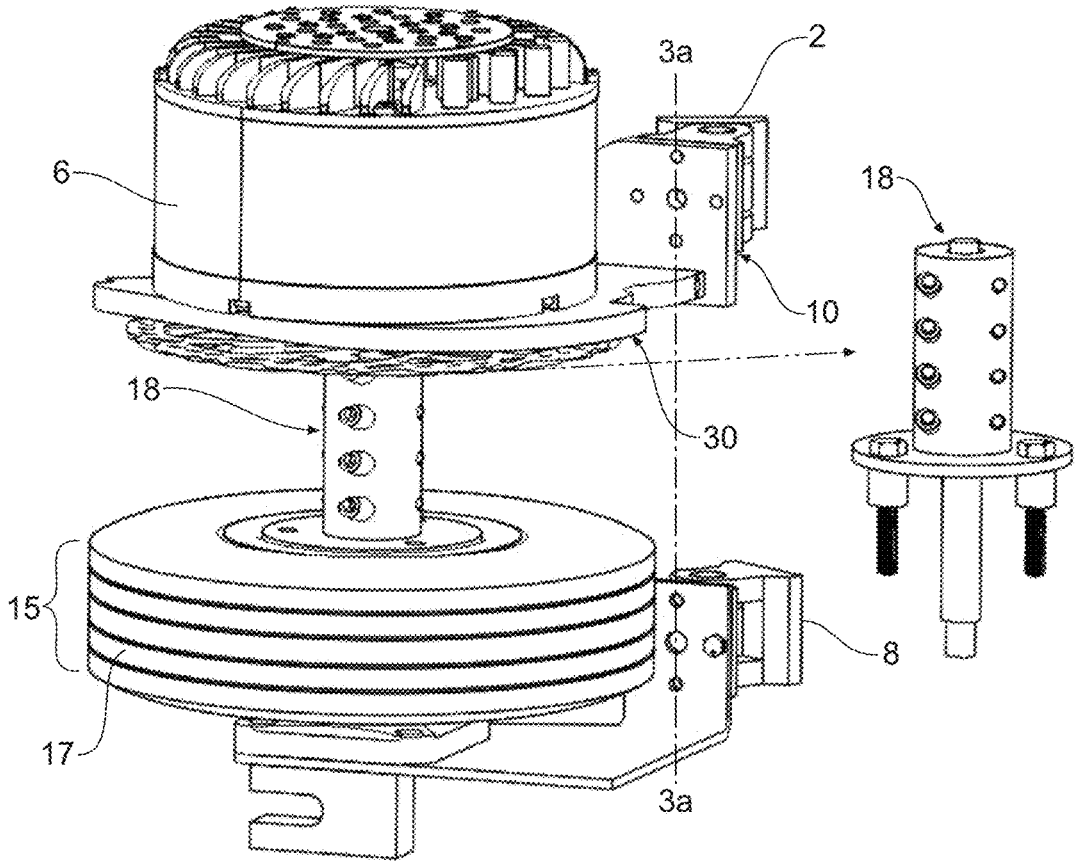
FIG. 3A is a perspective view of the electric motor, driven wheel and respective mounting brackets and a shaft coupler before assembly.

An embodiment disclosed herein is described in detail, including the following items which are identified in various Figures. The chassis 1 of the support carrier in FIGS. 1 and 2 is constructed of folded sheet metal and within the interior (as depicted in FIG. 1) of the chassis, various elements are mounted. The electric motor 6 is mounted on a motor support bracket 30, and the bracket is rotatably supported, in this embodiment, by a top hinge assembly 2 which is connected to the chassis (FIG. 1). There is also a bearing 10 (FIG. 3A which is arranged to rotatably support the driven wheel 15 having a tyre 17 and a shaft coupler 18 to connect the spindle of the electric motor to the hub of the tyre (the shaft coupler is not shown in FIG. 1 but shown as 18 in FIG. 3A) which is one embodiment of a coupling between the hub of the tyre and the motor. In a further embodiment which is lighter, the shaft coupler is removed from the drive wheel hub and now machined as a solid piece which connects the driven wheel and brake rotor directly to the motor shaft. The rotation of the motor support bracket 30 (FIG. 3A) is achieved by using a bottom hinge assembly 8 (with respect to the top hinge assembly axes of both being aligned along lines 3*a*-3*a* as depicted in FIG. 3A). Thus both hinge assemblies (2 and 8) are fixed to the chassis by bolts (not shown) so as to rotate in unison and secure the combined electric motor and wheel support assembly onto the chassis. The described mounting of the electric motor and wheel support assembly for supporting the shaft and providing a single axis of rotation for the electric motor and wheel is depicted in FIGS. 1, 3A, and 3C.

Figure 3B:
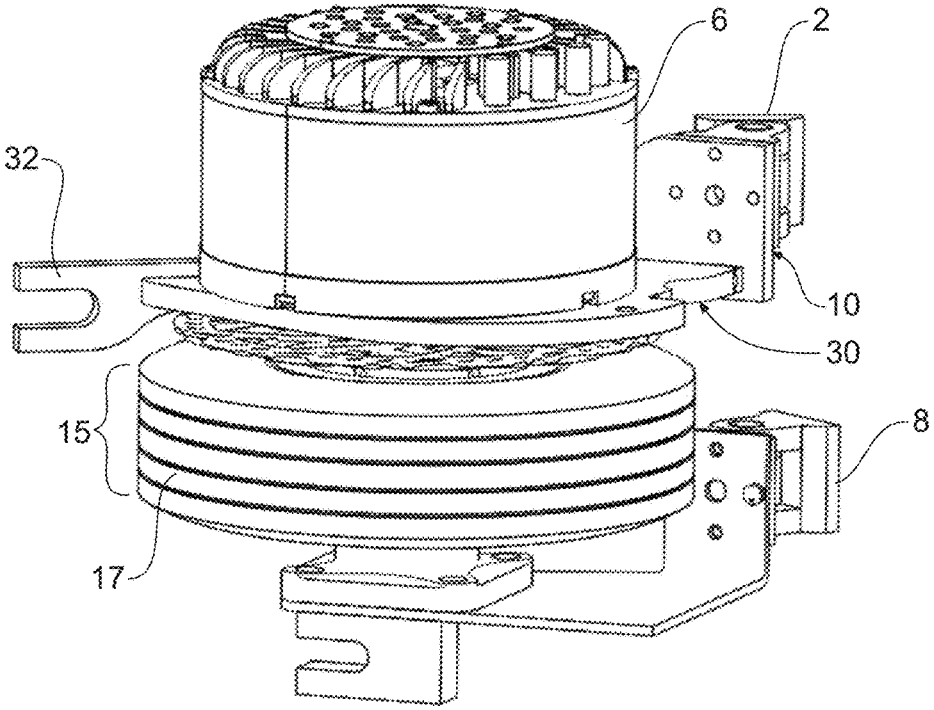
FIG. 3B is a perspective view of another embodiment of the electric motor, driven wheel and respective mounting brackets and a shaft coupler which comprises fewer components than the embodiment of FIG. 3A and thus has less weight.
Figure 3C:
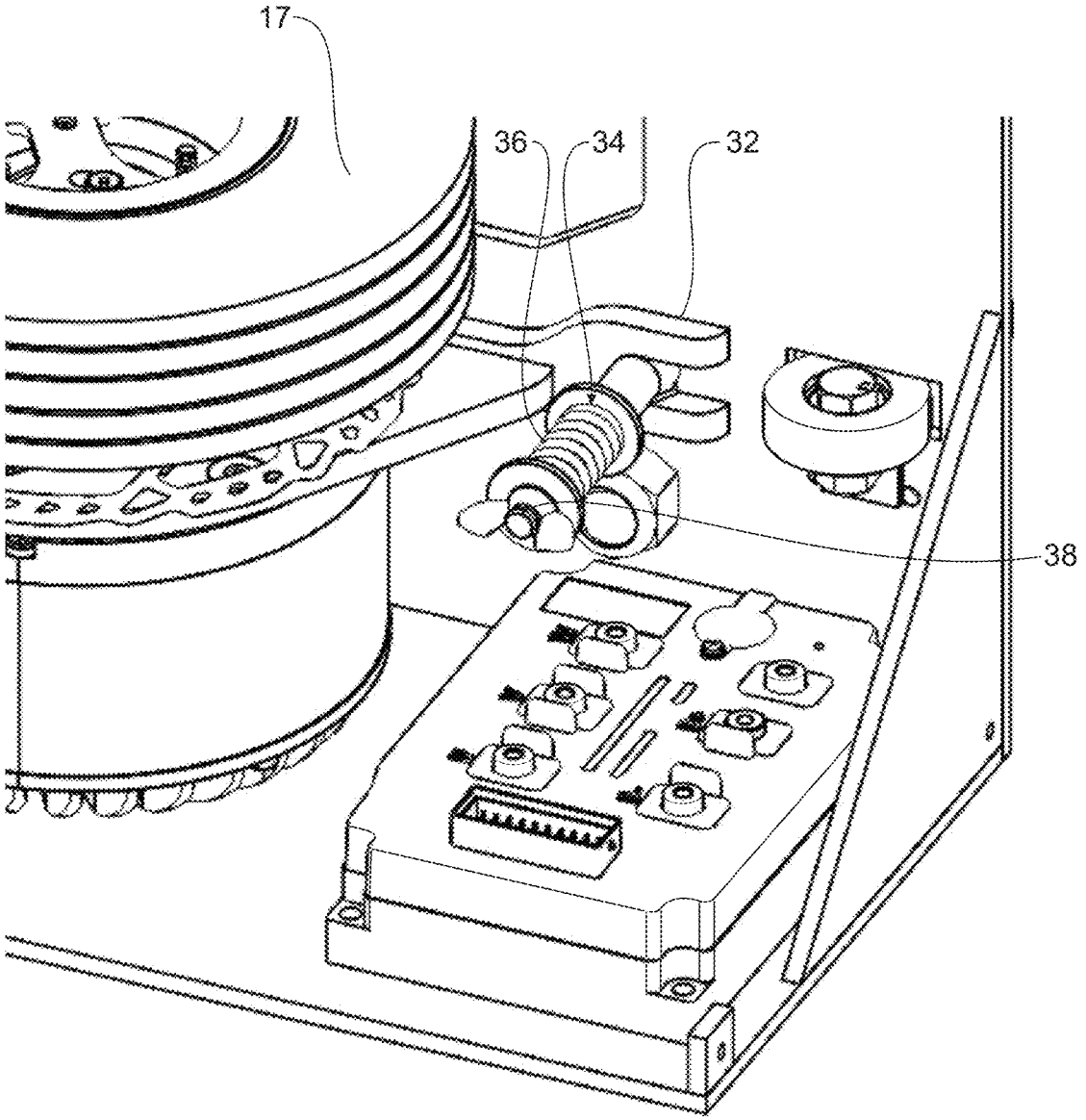
FIG. 3C depicts the bias arrangement.

In one embodiment an extension plate is attached or integral to the motor support bracket 30 to provide a fork 32 (example is depicted in FIG. 3B but not shown in FIG. 3A) to assist the clamping of the bearing bracket supporting in a rotatable manner the electric motor subassembly 8 and associated wheel (15, 17) to the inner wall of the chassis. When the electric motor 6 and wheel are fixed using the clamping of the bearing bracket a portion of the wheel is located external of the chassis and thus the support carrier to a suitable extent to become frictionally engaged with the support track, taking into account the spacing of the carrier housing from the support track.

In another embodiment, support for the electric motor and wheel support assembly needs to be movable. In this embodiment, the motor and wheel support assembly is rotatable about two axially aligned (dotted line 3*a*-3*a* of FIG. 3A) hinge assemblies 2 and 8). Thus, in use, the sometimes non-planar support track can be accommodated without transference to the chassis of the lateral movement of the wheel which is forced to roll along the sometimes non-planar (bumpy) support track to which the electric motor is connected. A biasing element 34 as depicted in FIG. 3C is arranged to bias the movement of the wheel/motor towards the support track, and in one embodiment the bias element is a spring 36 located between the head end of a continuous threaded bolt 38 having its other end attached to an internal wall of the chassis. In this embodiment, one end of the spring is located in the fork 32 (FIG. 3B), and the other end of the spring acts against the head end of the bolt, resulting in the wheel/motor being biased towards the support track.

Figure 4:
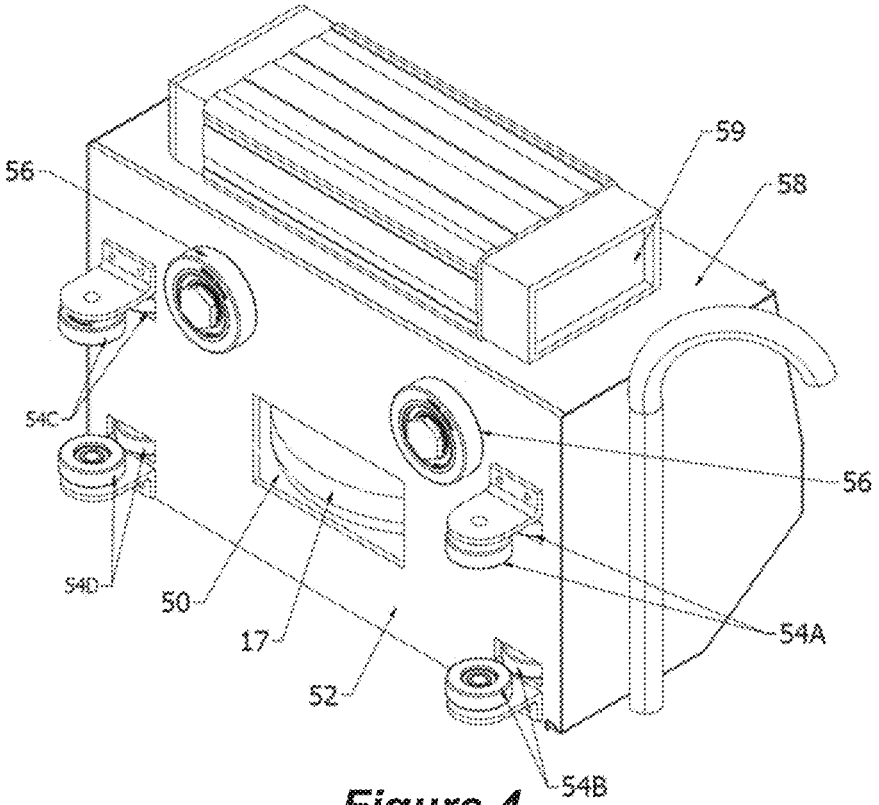
FIG. 4 depicts a perspective view of an embodiment of the support carrier showing the side which engages with the support track (not shown)

In an embodiment, a 3 kW DC electric motor 6 is mounted in the chassis 1 along with a rechargeable battery 59 (depicted in FIG. 4 mounted on the top of the carrier housing 58). The battery is rechargeable and multiple batteries are available at any one time to allow for the primary battery to be replaced (removable) at a moment's notice. Thus the battery fixing or attachment is adapted to safely attach the battery to the internal or external regions of the carrier housing and provide for the easy unfastening and removal of the battery from the carrier housing as well as to provide for the easy replacement into or onto the carrier housing of a replacement (fully charged) battery.

Referring to the embodiment depicted in FIGS. 3A and 3B and 3C, a shaft coupler 18 adapts the short shaft of the electric motor subassembly 8 to the hub of the support track engagement wheel with its tyre 17. The coupler provides for the wheel to be mounted very closely to the end of the driven axle of the electric motor so as to lessen the distance over which radial load on the axle is applied.

FIG. 4 depicts a rear perspective view of an embodiment of the support carrier showing the side which engages with the support track (not shown). There is an array of guide elements in this embodiment being guide wheels located about the aperture 50 in the rear plate 52. The tyre 17 extends through the aperture and external of the carrier housing 58. Also depicted in FIG. 4 are pairs of opposed guide wheels 54A, 54B, 54C and 54D which are spaced sufficiently far apart to allow the snug passage of the vertically orientated support track. Pairs of opposed guide wheels 54B and 54D have bearings which are arranged to roll and minimise the rolling friction of the support carrier especially when the support carrier is guided along a curved portion of the support track. There is in this embodiment an additional pair of wheels 56 located near the top of the rear plate of the chassis of the carrier housing. The pair of wheels forming the suspension arrangement are arranged to roll over the top surface of the support track, in this arrangement the flat upper surface (narrowest side of the rectangular cross-section) of the elongate and rectangular support track. If those two pairs of wheels 56 were, along with the rotatable friction arrangement, the only portions of the support carrier to contact the support track, the support carrier might not stay on the support track. However, it may be possible to arrange a counterweight positioned to bias the support carrier not only downwards onto the top of the support track but also guide and force the rotatable friction arrangement against the side wall of the support track. This embodiment is not shown in the Figures.

Figure 5:
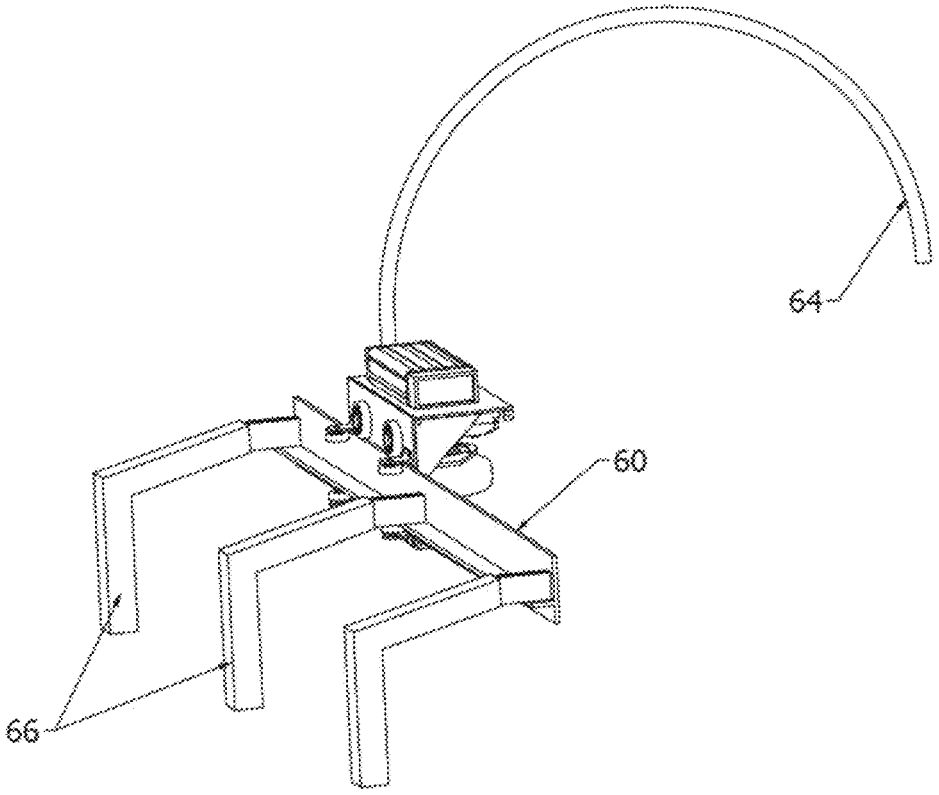
FIG. 5 depicts a similar perspective view as FIG. 4 of the same embodiment showing the support track and the lure displacement and suspension arm but without the cover of the carrier housing thus exposing the electric motor subassembly and other internal elements for illustrative purposes.

FIG. 5 depicts an embodiment of a straight portion of a support track 60 which is constructed of a substantially planar strip (rectangular cross-section) of metal-supported at intervals of about 5 metres. The strip of metal has a preferable dimension of 150 mm×10 mm and may or may not be treated or coated as the support track will be exposed to a variety of environmental conditions and although much more expensive the support track could be stainless steel, mild steel which has been anodised or powder-coated, galvanised, etc. The poles 66 supporting the support tracks are shaped to cantilever the support track from the vertical portion of the poles and arranged so that the support track runs continuously about the periphery of the greyhound racing track, the plan view shape of which may be oval, oblate or even circular. In another embodiment, the support track on which the greyhound racing lure is carried is attached to an existing greyhound racing barrier. The height of the support track from the ground is not critical since the lure hangs from the displacement and suspension arm 64 which positions the lure of the lure arrangement over and above the greyhound racing track surface at about the head-height of a pursuing greyhound. The arm can be any length and depending on the shape of the lure can be sized to any required length so that the height above the greyhound racing track surface of the lure is best for greyhound racing conditions. A vibration isolation element is provided between the carrier and the displacement and suspension arm, such as a spring. A spring of that type is often used to isolate long High-Frequency antennas from the vehicle support structure. In an embodiment, the lure arrangement includes an arm and on the free end of the arm is located a wheel arranged such that the free-wheeling wheel runs along the ground and provides further stability for the fast-moving suspended lure. For example, for some tracks, the lure arm extends 3.5 m out from the rail, and a supporting wheel reduces the drag force on the carrier housing. Alternatively, the lure arrangement includes a counterweight to counterbalance the weight of the lure. The support track is preferably located about one metre above the greyhound racing track surface.

The lure can be of many forms, and some are made to look like a rabbit, or any other animal, to attract greyhounds and encourage them to run after the fast travelling lure. Velocities of up to 70 kilometres per hour will be required and acceleration that is commensurate with a greyhound's ability to reach 30 kilometres per hour within six strides from a standing start.

In another embodiment (not depicted) of the support track is a stationary cable along which the support carrier is adapted to engage. The support carrier is suspended from a cable such that the cable passes through the support carrier or the support carrier is suspended below or on top of the cable. The use of one or more gyroscopes to stabilise the support carrier as it travels along the support track would allow the support carrier to move in a stable manner below or even on top of the cable or other shape or form of support track.

The support carrier includes at least a wireless communication receiver 82 (FIG. 8) for receiving a signal for operating the application of electric power to the electric motor. The receiver is powered from the rechargeable battery 59 (FIG. 4). The receiver's frequency of operation, the modulation scheme and signalling protocol need only be compatible with the remote controller's wireless transmitter frequency; modulation, and signalling protocol, so that the signals sent from the controller to the transmitter can be communicated to the wireless communications receiver mounted in the lure support carrier. The wireless communication transmitter is adapted for transmitting a signal to the wireless communication receiver for controlling the operating application of electric power to the electric motor. The transmitter also includes a user control to control the signal.

The transmission power of the wireless transmitter is a factor since it determines the likelihood of the wireless communications receiver receiving sufficient signal strength to reliably receive and demodulate the transmitted signal no matter where on the greyhound racing track it may be. The high signal strength can also overcome the adverse effects of one or more of weather; electric noise referred to as electromagnetic interference (EMI) generally created by the electric motor and associated control circuits; large objects located intermittently between the transmitter and the carrier housing, external radio frequency noise, and deliberate attempts to interfere with the signal, etc.

In an embodiment a transceiver is mounted in the carrier housing and the frequency of operation and security measures taken are a matter of design choice and may change over time. The receiver can also be programmed to provide default commands to the motor control circuit of the support carrier in the event of the loss of communication with the designated transmitter, particularly useful for bringing the support carrier to a prompt halt in such circumstances. In an embodiment, there are two antennas to provide diversity in the received signal.

An electric motor control module 80 (FIG. 8) is configured to be in operative connection to the wireless communication receiver 82 (FIG. 8) to receive demodulated signals for transformation into controls to operate the provision of power from the battery 59 to the electric motor. The receiver is generally a part of a transceiver (transmitter/receiver).

In an embodiment, there are two control modes usable by a user of the remote control. The first is a throttle control arrangement where throttle control is provided via the operator control to the remote control's transmitter and then received by the receiver in the support carrier. The received signal is translated from a Pulse Width Modulation signal to a voltage between 0.8 volts and 4.2 volts by the processor in the motor control module. This transformation is done in software but could be done in hardware using techniques well known in the electronics and software field. Following this transformation, the voltage is applied as a control voltage to, in this embodiment, a Brushless Direct Current Motor (BLDC) to adjust the motor current and thus the rotational speed of the spindle of the motor, which translates torque and power into the driven wheel.

In another embodiment, the user using the controller sets the required velocity of the support carrier. For example, 35 kilometres per hour and that setting is communicated to the receiver mounted in the support carrier and used in a feedback loop by the processor (microcontroller 84 of FIG. 8), such that the velocity as determined from the rotation of a motor phase wire bundle provides the actual velocity. The processor transforms the input signal into a velocity measure according to a mathematical formula well known to those of skill in the engineering and software fields. Thus the motor controller increases or decreases the drive to the motor so as to substantially maintain the set velocity. The measurement of the actual velocity application by the use of a sensor, such as a Hall effect device, the output of which is received by an input to the processor, or a conditioned input to the processor. In a further embodiment a proportional-integral-derivative controller provides a control loop mechanisms employing feedback, which maintains speed with delay but the delay can be controlled, and a reduction in overshoot, are all considerations for the designer and implementer of a proportional-integral-derivative controller and tuning of the proportional-integral-derivative controller takes into consideration the process to be controlled, and a trial and error approach can be just as useful as using a process reaction curve or other tuning methods. There are advantages in being able to remotely tune the proportional-integral-derivative controller which can be used to optimise the performance of the lure.

Of advantage in the control arrangement is that the input to the transmitter is Pulse Position Modulation (PPM) and the output of the receiver is Pulse Width Modulation (PWM), the latter being most suitable for servo control or motor control means that the remote control input is exchangeable for other types or manufacturers.

Figure 8:
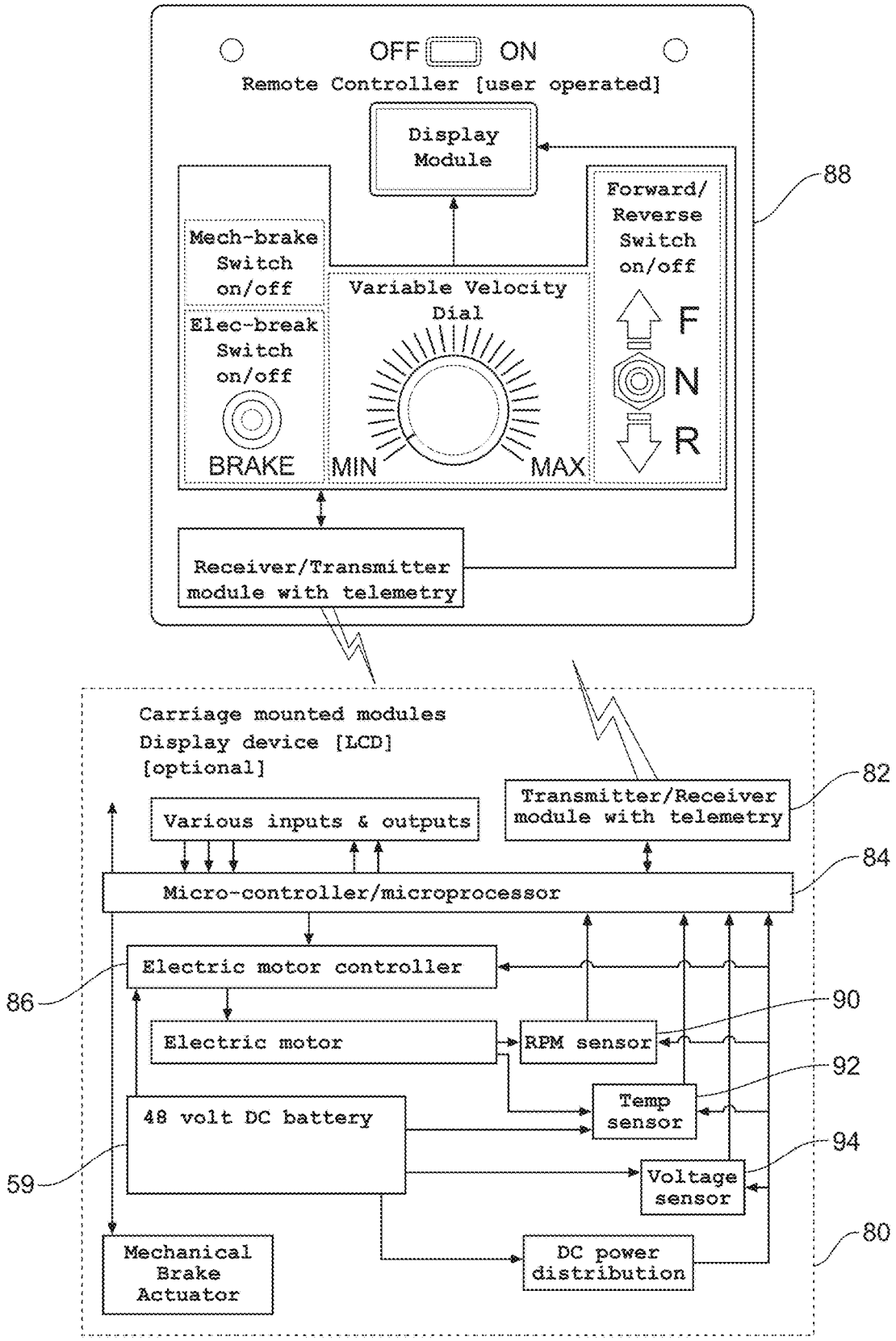
FIG. 8 is a functional block diagram of a lure support carrier control arrangement.

The control module 80 includes a microcontroller 84 which receives output signals from the receiver 82 into one or more inputs to the microcontroller. The microcontroller is a programmable device, and in an embodiment, the program is supplied from a non-transitory memory device that is part of the microcontroller device, so it is not shown as a separate part, such as an EPROM. As described, there are control modes, and there may be many of them depending on the track, the motor, the braking mechanisms available, etc. At least one of the outputs of the microcontroller (although multiple outputs are depicted in FIG. 8) is operatively connected to a circuit which controls the motor, which in turn controls the provision of power (voltage and current) to the electric motor 6 in a manner which controls the rotation of the spindle to which the wheel is connected, and in an embodiment a disc 20 of a disc brake arrangement (FIG. 1).

The electric motor controller 86 can be configured to control various forms of braking in conjunction with the electric motor or other brake mechanisms. In an embodiment the electric motor control module can in certain circumstances, such as the receipt of a control signal to stop the movement of the support carrier; apply one or more voltages and currents and phases and in a pulsed mode motor control the shape and on/off timing of the pulses can be used include Pulse Width Modulation; activate dynamic braking where the motor becomes regulated by a rheostat and the electricity generated as the motor slows down is dissipated as heat or regenerated and the power is returned to the supply (if sinusoidal AC is used to power the electric motor); while retarding the rotation of the motors' spindle/axle can be achieved in mechanical arrangements, such as a disc brake having a mechanically or hydraulically operated brake calliper, which in one embodiment may be remotely controlled so as to adjust the power or power assist of the respective brake system. The process described is not the only method for dynamically braking the operation of an electric motor, and in a DC electric motor example, it is possible to connect a power resistor across the DC electric motor armature, and power dissipates as heat, and there is also a regeneration option, and others.

The electric motor controller 86 may also be involved even when the braking is achieved with a separate mechanical braking arrangement. In this case, the electric motor control module ceases or cuts off the supply of electricity to the electric motor. There is also a control voltage applied to an electric actuator of a mechanical device, which in turn applies friction to, in one example the rotating wheel, and in another example the support track, and in another example a disc 20 of a disc brake system associated with the driven wheel when it is not being driven by the electric motor. In another form not depicted there is an arm extending from the chassis 1 having material at the free end thereof, with a high coefficient of friction, such that the material abraids the support track until the support carrier stops. The condition in which the mechanical braking is actuated, by way of example, when the movement of the support carrier along the support track needs to be ceased more quickly than when using electric braking techniques, may include a combination of braking methods to do so. It may also be possible to increase the rolling friction of the surface of the suspended track such as, for example, roughening of the surface of the track along a portion of the track used primarily for stopping the support carrier. The roughening is achieved by adding a layer of paint, tape, or other material to the relevant portion of the support track, at least making the addition to a portion of the side of the track on which the support carrier travels. The addition, for example, can comprise multiple protrusions of the surface material such as knurling or slots ground into the surface of the track, or the application of material such as metal filings and adhesive on to the track, to present a roughened surface. The support track is absent a portion of the track surface or built-up to present a track portion which has a higher coefficient of friction against the driven/rolling wheel.

Yet further, the electric motor controller 86 may also be involved even when the braking is achieved with a combination of an electric braking technique and a separate mechanical braking arrangement. The condition in which the combination of braking is required will likely be very rare, but could be required when, for example, a human is in the path of the rapidly moving (up to 70 km per hour) support carrier or supported lure, in which case an almost immediate application of a brake function using the most effective stopping technique or combination of techniques is required.

It may be sufficient for the remote control 88 to merely provide controls for starting and velocity control of the electrically motorised support carrier. Thus the control module 80 may also include one or more additional features that are primarily provided in the form of software. For example, signalling protocol to ensure that only one remote control device can control the motorised support carrier at any one time; protocol or wireless configurations which are immune to interference and provide surety of communication of control command from the remote control to the motorised support carrier; failsafe operational conditions which ensure safety of both humans and animals in the vicinity of the assembly during and after operations associated with the control of the greyhound racing lure (for example, when a control signal is not provided for a predetermined period if the support carrier is moving, then the support carrier self-controls to a halted state, in a predetermined manner); battery monitoring (including reporting the voltage and battery capascity as a percentage which is obtainable from the battery UART protocol to the controller and display or alerting to the user of the controller); electric motor overheating detection and fail over (especially while the electric motor is operated during a race); potentially supplying maintenance and operational operating characteristics (as data or indicators) during and after the use of the support carrier; potential for the provision of the recording and local or remote storage of operational conditions; recordal, storage and access and reporting of hours of operation; reminder generation of scheduled maintenance; et cetera.

The carrier housing in an embodiment can house video recording or video broadcasting equipment. The arrangement may include one or more such devices or one or more lenses for capturing the race from the rail perspective for use during or after a broadcast of the race and useful for disputes or judging events that occur during the race from the release from the starting gates to the finish line. The various suspension arrangements will assist in keeping the recording platform stable, but it also possible to include a gimbal or similar arrangement to stabilize the camera and various software related anti-shake routines can be used to make the recorded video stable for viewing purposes.

The control module 80 may include digital data memory elements transitory and non-transitory for storing the types of data described above as well as any software program that is used to control the operation of the electric motor control module, wherein some of that memory may be non-volatile. The steps of a method or algorithm described in connection with the embodiments disclosed herein may be embodied directly in hardware, in a software module executed by a processor, or in a combination of the two.

The control module 80 can also be arranged to work with one or more sensors, which detect the surrounding environment (not shown). For example, the detection of the distance between the lure and the closest racing greyhound can be used to control the velocity of the support carrier. In the case of controlling the velocity of the support carrier in a race according to the proximity of the greyhound to the support carrier and thus the lure it carries, in one example, the distance between them can be preset to 6 meters. In another example, a sensor capable of detecting an object that should not be within a predetermined distance of the support track (a forward-looking (look-ahead) sensor, i.e. in the direction of travel of the support carrier). The sensor is adapted to look ahead say 60 to 80 metres thus providing a time buffer of about 3 to 4-seconds before impact, assuming the support carrier is travelling at the higher race velocities of about 70 km per hour. The look-ahead distance needs to take into account the curved racing track; it needs to take into account the possibility of higher velocity; and the braking capabilities of the brake mechanisms. A suitable sensor may be a LiDAR/sonar/radar which is adapted to be carried on the support carrier. The sensor for detecting an object in danger from the travelling support carrier may rely on an array of sensors built into the suspended support track, or other sensor arrays associated with the support track poles and other infrastructure.

There is also an embodiment where there is a failsafe support carrier breaking arrangement. For example, a directional automatic brake sensor or sensors can be used for straight tracks, wherein a Hall Effect sensor in the housing is positioned on the carrier housing 58 and a magnetic element is fixed at a location along the track to be detected by the Hall Effect sensor and for associated circuitry to trigger the operation of the brake function at whichever level is suitable for the condition, such as to stop the travel of the lure support arrangement before reaching the end of the available rail. The Hall Effect and magnet arrangement could be substituted for by other types of sensor and triggering element combinations.

Various other sensors are usable with the electric motor control module. By way of example: a Revolutions Per Minute (RPM) sensor 90 applied to the wheel or the spindle of the electric motor; one or more temperature sensor 92 located to detect the temperature of the motor and the control modules, etc.; and voltage and current detectors 94. All the mentioned sensors are providing their output to a telemetry module which can then send those sensor signals or transformed versions thereof to the microcontroller 84 for local processing, or provide them to the user control location for monitoring and possible recording. One or more thresholds or allowable ranges are programmable so that the operator or the monitoring program within the support carrier can act on the event of an exceeded threshold or operation outside of a predetermined range.

Figure 7A:
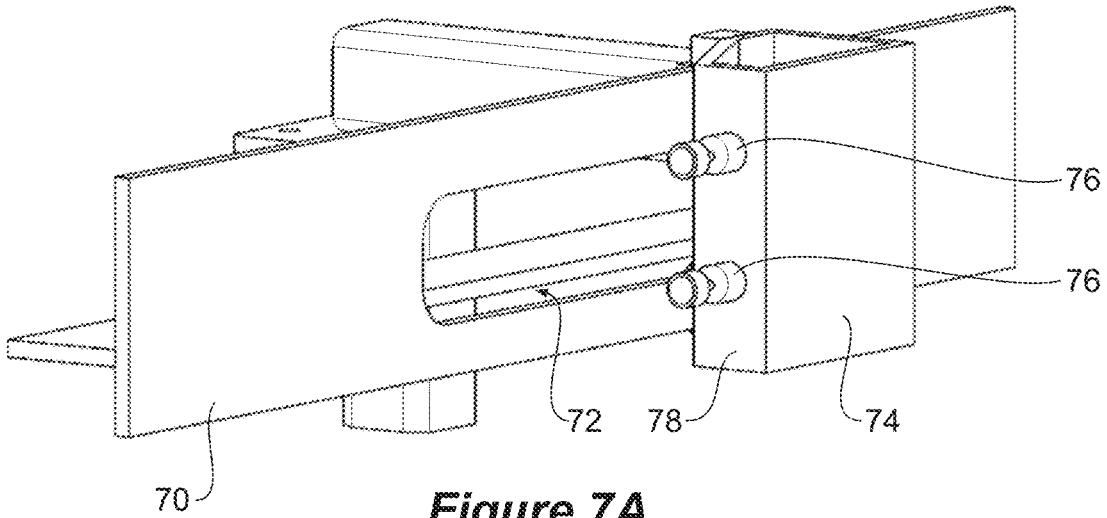
FIG. 7A depicts a side perspective view from the greyhound racing trackside of one embodiment of an end-of-line support track portion of a greyhound racing lure support carrier support track.
Figure 7B:
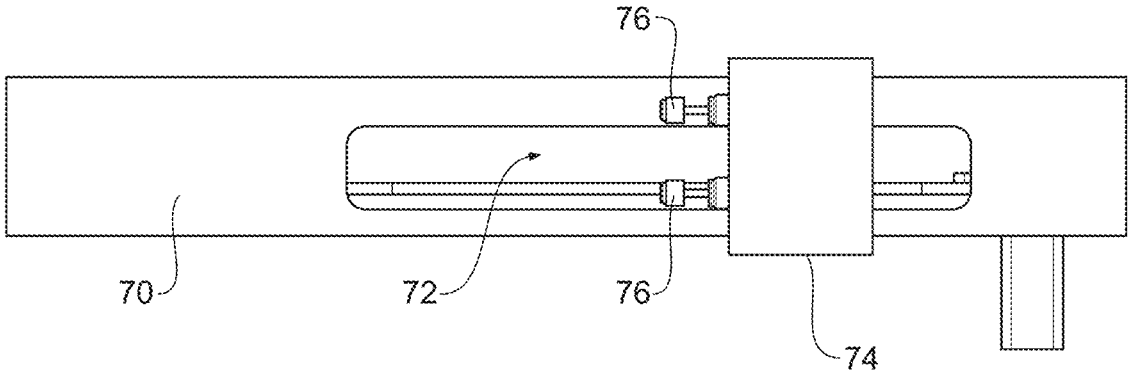
FIG. 7B depicts a side front view of the embodiment of FIG. 7A.

FIG. 7A depicts a support track portion located along the greyhound racing track at a point at where the support carrier of the embodiment depicted in FIGS. 1, 2, 4 and 5 is intended to halt any linear motion of the support carrier. FIG. 7B also depicts a side front view of the embodiment of FIG. 7A. As depicted, the end-of-line support track portion 70 of the support track is used for straight tracks, typically of 300 to 400 metres in length. Straight greyhound racing comprises a small percentage of greyhound racing tracks.

Figure 7C:
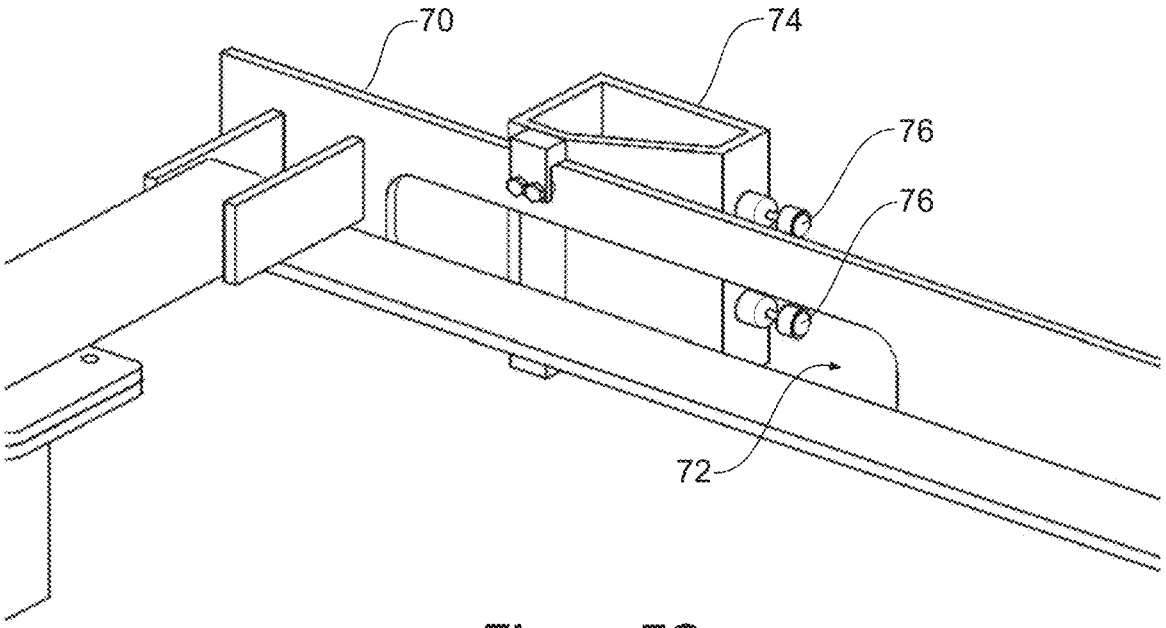
FIG. 7C depicts a rear perspective view of the embodiment of FIG. 7A.

There are two features of the end-of-line support track. A centrally located opening 72 in the support track portion is provided, such that the rotatable friction arrangement connected to the driven axle no longer engages with the support rack when the rotatable friction arrangement enters the opening of the end-of-line support track. It may be that the slotted distance is continued over two or more support track sections. The second feature is the use of a bumping block 74 (also referred to as a buffer stop or a stop block) to prevent the support carrier moving past the end of the end-of-line support track portion 70. In the embodiment depicted in FIG. 7A, there are two spaced energy-absorbing elements 76 (there could be one or more such elements, but two are used in this embodiment), co-located with the end-of-line support track portion, arranged to mechanically or hydraulically dissipate the energy of the impact by the support carrier. In this embodiment the energy absorbing elements are rubber and at least one spring arranged on a bolt attached to a vertical wall 78 of the bumping block 74 (the bumping block could also comprise a pillow with various grades and layers of foams and viscoelastic materials). FIG. 7C is a rear perspective view of the end-of-line support track and bumping block. The bumping block shown in FIG. 7C is hollow and dependent on the strength of the material of the bumping block it will be capable of collapsing under the force of the collision in a manner that decelerates the colliding support carrier during the collapsing phase. The material of the bumping block structure can be rubber or light sheet metal.

Assessing the weight and quantity of components (excluding the electric motor and wheel in this comparison) of different embodiments allows one quantifiable consideration of those different embodiments, wherein one embodiment has a weight of 5.6 kg and totals 43 components, and another embodiment weighs 2.7 kg and totals 17 components, which equates to a 52% reduction in weight and a 60% reduction in components. The benefit of a lighter support carrier is longer battery life and less wear and tear due to the lesser forces on bearings and support elements, which in turn likely increases reliability and repeatability of the operation of the support carrier by the remote control operator. As stronger and lighter material and components become available, there will continue to be reductions in weight. There is also the consideration of the forces involved in the added friction caused by the multiple contacts of the support carrier with the support track as one or more wheels used for support and guidance against the track are bearing on the track surface and more so when the support carrier is moving about a curved portion of the supporting track. In such circumstances, there needs to be appropriate consideration of the increased traction required to maintain the velocity of the support carrier. If the frictional forces outweigh the applied power and its efficiency of transference to the motion creating friction of the driven wheel on the track, the slower velocity can be a hindrance or make the support carrier useless for this task. Free-wheeling pairs of opposed guide wheels 54A, 54B, 54C and 54D are therefore chosen carefully to provide minimum frictional engagement with the horizontal surface of the support track. This feature is needed when the support carrier is travelling along the straight or curved portion of the support track, but especially when the inner pair of wheels are engaged with the inside surface of the support track while the support carrier is moving at high velocity through an inside curve of the path of the support track. Further, the bias forces applied to the driven wheel onto the vertical surface of the support track is also balanced to achieve the desired friction to drive the support carrier along the support track but also not so lightly or hard as to make motion difficult for the motor to deliver the necessary rotational energy to the driven wheel. All of the wheel guides and the driven wheel preferably have bearings, and the quality of those bearings will directly affect the short and long-term coefficient of friction which ideally should be relatively low over the lifetime of the bearing.

In an embodiment there is a separate circuit or an output pin or pins of the processor in the motor control module or a separate processor that can be used to drive a circuit adapted to operate and control lights (Light Emitting Diodes are a preferable light source) one or more of which are located on the carrier housing 58 or incorporated into the lure arrangement. Yet further artificial or recorded sounds intended to lure the greyhound as an alternative to the lure or to supplement the lure can be generated by a separate circuit or a processor. In either or both cases simultaneously the light/s and sound can be remotely controlled.

As used in the specification and claims, the singular form "a", "an" and "the" include plural references unless the context dictates otherwise.

The present disclosure may use the term "comprise" (open-ended) or "consist essentially of" the components of the present disclosure as well as other methods or elements described herein. As used herein, "comprising" means the elements recited, or their equivalent in structure or function, plus any other element or elements which is not recited. The terms "having" and "including" are also to be construed as open-ended unless the context suggests otherwise. As used herein, "consisting essentially of" means that the claimed arrangement, method and system may include ingredients in addition to those recited in the claim, but only if the additional ingredients do not materially alter the basic and novel characteristics as claimed.

Where used herein, the term "and/or" when used in a list of two or more items means that any one of the listed characteristics can be present, or any combination of two or more of the listed characteristics can be present. For example, if a step is described as containing characteristics A, B, and/or C, the step can contain A feature alone; B alone; C alone; A and B in combination; A and C in combination; B and C in combination; or A, B, and C in combination.

Although the invention has been disclosed in its preferred forms, the specific embodiments thereof as disclosed and illustrated herein are not to be considered in a limiting sense, because numerous variations are possible. Applicants regard the subject matter of their invention to include all novel and non-obvious combinations and sub-combinations of the various elements, features, functions, and/or properties disclosed herein. No single feature, function, element or property of the disclosed embodiments is essential. The following claims define certain combinations and sub-combinations of features, functions, elements, and/or properties that are regarded as novel and non-obvious. Other combinations and sub-combinations may be claimed through amendment of the present claims or presentation of new claims in this or a related application. Such claims, whether they are broader, narrower, equal, or different in scope to the original claims, also are regarded as included within the subject matter of an applicant's invention.

The invention claimed is:

1. A greyhound lure support carrier engageable with a support track located about a greyhound racing track, the support track forming an inside barrier of the greyhound racing track, the carrier comprising:

a chassis accommodating:

a battery to supply electric power;

an electric motor, the electric motor operatively connected to the battery;

a rotatable friction arrangement driven by the electric motor and located so as to frictionally engage with the support track;

a suspension arrangement moveable along an upper portion of the support track to permit suspension of the chassis from the support track;

a wireless communication receiver for receiving a signal for operating application of electric power to the electric motor;

an electric motor control module in operative connection to the wireless communication receiver and operable control the electric motor; and a lure arrangement to attract greyhounds, wherein the rotatable friction arrangement is arranged with respect to the chassis such that engagement with the support track includes a lateral component with the engagement occurring on a side surface of the track between an upper and lower surface of the track.

2. The greyhound lure support carrier according to claim 1 further comprising at least one guide assembly to maintain a distance separation of the support carrier from the support track when the support carrier is moving along the support track.

3. The greyhound lure support carrier according to claim 2 wherein the support track has a vertical surface, and wherein the at least one guide assembly further comprises:

an upper guide assembly; and a lower guide assembly.

4. The greyhound lure support carrier according to claim 2 wherein upper guide assembly further comprises:

a biasing element located between the chassis and the wheel support assembly arranged to dampen the motion, in use, of the wheel support assembly and bias the free-wheeling wheel against the upper portion of the support track.

5. The greyhound lure support carrier according to claim 1 wherein the battery is removable and replaceable with another battery.

6. The greyhound lure support carrier according to claim 1 wherein the lure arrangement further includes a displacement and suspension arm which positions a lure of the lure arrangement over and above the greyhound racing track surface.

7. The greyhound lure support carrier according to claim 1 further including:

a lure arrangement attached to the chassis.

8. A greyhound racing system comprising:

a support track positioned about a greyhound racing track, the support track forming an inside barrier of the greyhound racing track;

a greyhound lure support carrier engageable with the support track, comprising:

a chassis comprising, a battery to supply electric power;

an electric motor, the electric motor operatively connected to the battery;

a rotatable friction arrangement driven by the electric motor and located so as to frictionally engage with the support track with the engagement occurring on a side surface of the track between an upper and lower surface of the track;

a suspension arrangement moveable along an upper portion of the support track to permit suspension of the chassis from the support track;

a wireless communication receiver for receiving a signal for operating application of electric power to the electric motor; and an electric motor control module in operative connection to the wireless communication receiver and the electric motor and operable to control the motor; and a lure attachment arrangement; and a wireless communication transmitter for transmitting a signal to the wireless communication receiver for controlling the operating application of electric power to the electric motor; and a user control to control the signal, wherein a lure is attachable to the lure attachment arrangement, the lure adapted to attract greyhounds as the support carrier moves along the support track.

9. The greyhound racing system according to claim 8 further comprising:

an end-of-line support track portion located at an end of the support track, the end-of-line support track portion having an opening such that the rotatable friction arrangement no longer engages with the support rack when the rotatable friction arrangement enters the opening in the end-of-line support track.

10. The greyhound racing system according to claim 9 further comprising:

an energy-absorbing element located adjacent the end-of-line support track portion arranged to mechanically or hydraulically dissipate the energy of a greyhound lure support carrier impacting on the energy-absorbing element.

11. The greyhound lure support carrier according to claim 1 wherein the rotatable friction arrangement further comprises a tyre.

12. The greyhound lure support carrier according to claim 1 wherein the rotatable friction arrangement further comprises a wheel and a tyre.

13. The greyhound lure support carrier according to claim 1 wherein the suspension arrangement comprises at least two spaced-apart freely rotating wheels.

14. The greyhound lure support carrier according to claim 1 further comprising a brake system associated with the rotatable friction arrangement.

15. The greyhound lure support carrier according to claim 1 wherein, in use, the carrier has a centre-of-mass laterally outboard of the support track such that gravity results in the rotational friction arrangement being biased into engagement with the support track.

16. A greyhound lure support carrier engageable with a support track located about a greyhound racing track, the support track forming an inside barrier of the greyhound racing track, the carrier comprising: a chassis accommodating:

a battery to supply electric power;

an electric motor, the electric motor operatively connected to the battery;

a rotatable friction arrangement driven by the electric motor and located so as to frictionally engage with the support track;

a suspension arrangement moveable along an upper portion of the support track to permit suspension of the chassis from the support track;

a wireless communication receiver for receiving a signal for operating application of electric power to the electric motor;

an electric motor control module in operative connection to the wireless communication receiver and operable to control the electric motor; and a lure arrangement to attract greyhounds, wherein the rotatable friction arrangement is arranged with respect to the chassis such that engagement with the support track includes a lateral component.

17. The greyhound lure support carrier according to claim 1 wherein the rotatable friction arrangement comprises a wheel and a tyre.

18. The greyhound lure support carrier according to claim 1 wherein the suspension arrangement comprises at least two spaced-apart wheels.

19. The greyhound lure support carrier according to claim 1 further comprising a brake system associated with the rotatable friction arrangement.

20. The greyhound lure support carrier according to claim 1 wherein, in use, the carrier has a centre-of-mass laterally outboard of the support track such that gravity results in the rotational friction arrangement being biased into engagement with the support track.

* * * * *